United States Patent [19]

Crimaldi

[11] 4,269,122

[45] May 26, 1981

[54] MOTION PRODUCING MECHANISM

[76] Inventor: Daniel Crimaldi, 2002 Reservoir Rd., Reading, Pa. 19604

[21] Appl. No.: 66,238

[22] Filed: Aug. 13, 1979

[51] Int. Cl.[3] ..... B61B 13/00

[52] U.S. Cl. ..... 104/167; 104/56; 105/29 R

[58] Field of Search ..... 104/53, 56, 57, 167; 105/29 R; 238/123; 49/352

[56] References Cited

U.S. PATENT DOCUMENTS

| | | | |
|---|---|---|---|
| 1,240,170 | 9/1917 | Block | 267/167 |
| 1,945,049 | 1/1934 | Lake | 40/415 |
| 2,599,760 | 6/1952 | Hanson et al. | 74/501 R |
| 3,187,451 | 6/1965 | Fontaine | 40/472 |
| 3,605,631 | 9/1971 | See et al. | 104/167 |
| 3,675,371 | 7/1972 | Golde et al. | 49/352 |
| 3,681,874 | 8/1972 | Golde et al. | 49/352 |
| 3,858,339 | 1/1975 | Short | 40/472 |
| 3,866,538 | 2/1975 | Forsey, Jr. | 104/167 |
| 4,074,463 | 2/1978 | Colanzi | 49/352 |

*Primary Examiner*—Richard A. Bertsch
*Attorney, Agent, or Firm*—Craig and Antonelli

[57] ABSTRACT

In systems for moving items such as novelties along a predetermined path, it is desirable that the system be lightweight and inexpensive, while being capable of forward and backward movement along the path. To accomplish this, an apparatus is provided for moving the item having a hollow holding means, such as a tube, with a slot which extends along the predetermined path. A helically threaded means is provided inside the holding means with a predetermined spacing between each of the threads. Driving means mesh with the space between the threads to move the helically threaded means relative to the hollow holding means. Mounting means, such as pins, are provided on the helically threaded means to extend through the opening in the holding means for connection of an item to the helically threaded means. As an alternative to the helically threaded means, a cable having alternating large and small diameter regions can be provided.

18 Claims, 8 Drawing Figures

MOTION PRODUCING MECHANISM

BACKGROUND OF THE INVENTION

The invention relates to a new apparatus for producing motion to drive items such as novelties, displays, or a variety of other items.

In the past, various gears, gear and rack combinations, chains, pulley and belt combinations, and pulley and gear combinations in conjunction with friction drives, or a combination of gear and friction drives, have been used to produce forward or backward, circular, eliptical, or wave-like motion. However, in such motion producing mechanisms using such drives, or combinations of such drives, the result is typically a relatively heavy, complicated, and expensive driving mechanism. For example, chains and racks are typically somewhat bulky. Similarly, endless belt systems generally require pulleys to stretch the belt across. Such pulleys take up extra space, as well as adding to the weight and cost of the system.

These factors are especially disadvantageous in the use of such motion producing mechanisms to drive novelty items or items for display since such items require the weight and cost of the drive mechanism to be as small as possible. Thus, what is needed, is a motion producing mechanism engineered to be of a very simple, light and inexpensive construction.

SUMMARY OF THE INVENTION

An important object of the present invention is to provide an inexpensive and simple means of producing a desired motion to a driven item.

Another object of the invention is to provide a motion producing mechanism which is of a lightweight construction.

Yet another object of the invention is to provide a motion producing mechanism to drive a novelty or display item either in a forward or backward direction along an eliptical or a circular path, in a wave-like motion clockwise or counterclockwise, or in a sideways or an up and down motion.

To accomplish these and other objects, the present invention provides an apparatus for moving an item along a predetermined path having a hollow holding means, such as a tube, with a slot which extends along the predetermined path. A helically threaded means is provided inside the holding means with a predetermined spacing between each of the threads. Driving means mesh with the space between the threads to move the helically threaded means relative to the hollow holding means. Mounting means, such as pins, are provided on the helically threaded means to extend through the opening in the holding means for connection of an item to the helically threaded means. As an alternative to the helically threaded means, a cable having alternating large and small diameter regions can be provided.

BRIEF DESCRIPTION OF THE DRAWINGS

The above objects and advantages of the present invention will become apparent from the following description taken in connection with the accompanying drawings, wherein.

DESCRIPTION OF THE PREFERRED EMBODIMENTS

Figure 1:
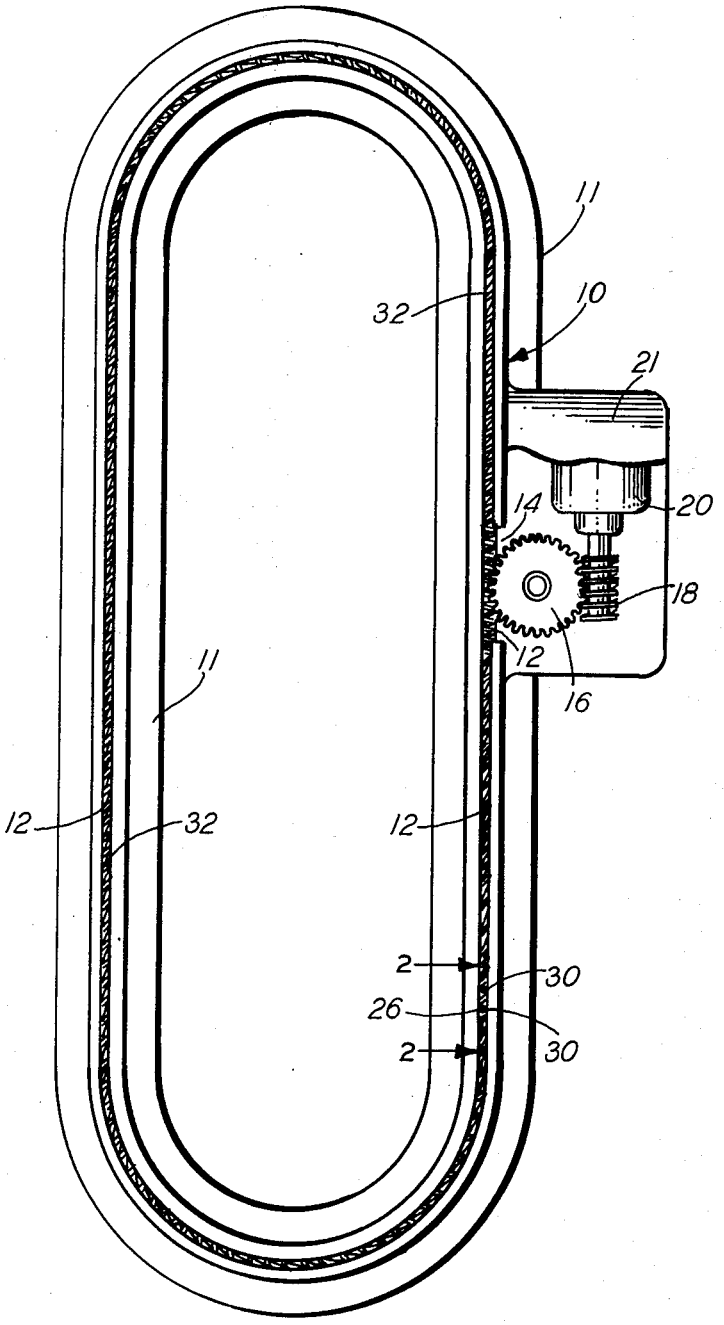
FIG. 1 shows an overall view of a motion producing apparatus according to the present invention.

Referring now to the drawings in detail, wherein like reference characters designate like parts throughout the various views, there is shown in FIG. 1 the completely assembled drive producing mechanism of the present invention.

Referring now to FIG. 1, a hollow tube 10 which forms a generally eliptical path is shown having an internal coil spring 12 extending along the entire eliptical path. The tube 10 is supported by a base 11 which can be made of any convenient material and to which the tube 10 is fastened by any appropriate conventional means. Normally, the base 11 would include a groove in which the tube 10 rests. For example, if $\frac{3}{8}$ inch tubing is used for the tube 10, a $\frac{3}{8}$ inch wide groove $\frac{1}{8}$ inch deep would be suitable.

A predetermined spacing is provided between each of the coils of the spring 12. An opening 14 is provided in the side of the tube 10 to allow a worm gear 16 to extend into the tube 10 to mesh with the coil spring 12. The pinion gear 16 is also coupled to a worm 18 mounted on a shaft of a drive motor 20. As shown in FIG. 1, the base 11 provides a support for the motor and gear assembly, which can be enclosed with a cover 21 if desired.

When the drive motor 20 is activated, it rotates the worm 18. The worm 18 has teeth of a size to match the teeth of the pinion gear 16, so that rotation of the worm 18 causes a corresponding rotation of the pinion gear 16. Similarly, the spacing between the coils of the coil spring 12 is chosen to correspond to the spacing of the teeth of the pinion gear 16 so that rotation of the worm gear 16 causes a linear movement of the coil spring 12 through the tube 10. Of course, the size of the motor 20, the worm 18, the pinion gear 16 and the coil spring 12 are determined by the thrust and speed necessary for the particular operation involved.

Figure 2:
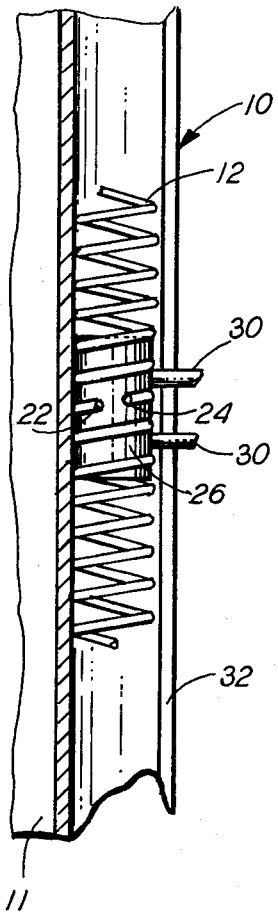
FIG. 2 shows a side view, partially in section, of the spring coupler mounted in the tube of FIG. 1, taken along section 2—2 of FIG. 1.
Figure 3:
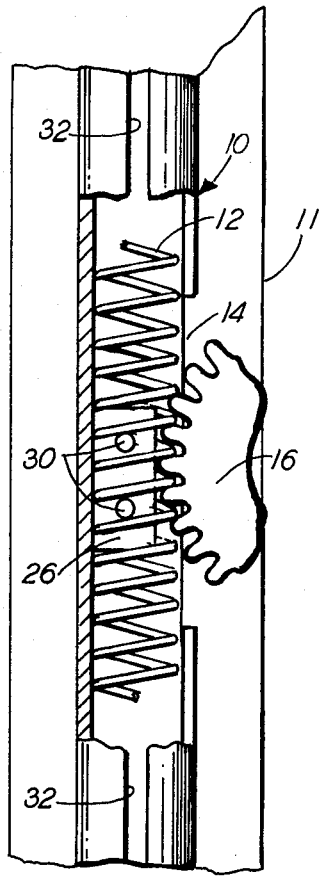
FIG. 3 shows a top view of the coupler mounted in the tube.
Figure 4:
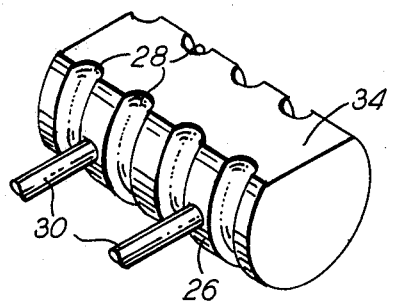
FIG. 4 shows a perspective view of the spring coupler of FIG. 1.

The respective ends 22 and 24 of the coil spring 12 are coupled together by a spring coupler 26 (see FIGS. 2 to 4). This spring coupler 26 is provided with grooves 28 having a depth and spacing corresponding to the coil spring spacing and the diameter of the spring material of the coil spring 20. Thus, the respective ends 22 and 24 of the coil spring 12 can be threaded into the grooves 28 of the spring coupler 26 to form the coil spring 12 into a closed path. Accordingly, when the drive motor 20 drives the coil spring 12, as described above, the spring 12 moves along this closed path inside the tube 10. Although the path shown in FIG. 1 is eliptical, it is, of course, understood that other suitable closed loop shapes such as a circular path, or a snake-like path could be used.

The spring coupler 26 includes a pair of pins 30 which extend through the spacing between coils of the coil spring 12 and through a slot 32 of the tube 10. These pins 30 serve to keep the spring coupler 26 aligned relative to the coil spring 12 and the tube 10, as well as allowing connection of a novelty item to the coupler 26. The slot 32 prevents the coupler 26 from turning inside the tube 10.

Referring now to FIGS. 3 and 4, a flat portion 34 is provided on the spring coupler 26 to allow for clearance of the gear teeth 36 of the pinion gear 16 when the spring coupler moves past the worm gear.

Figure 5:
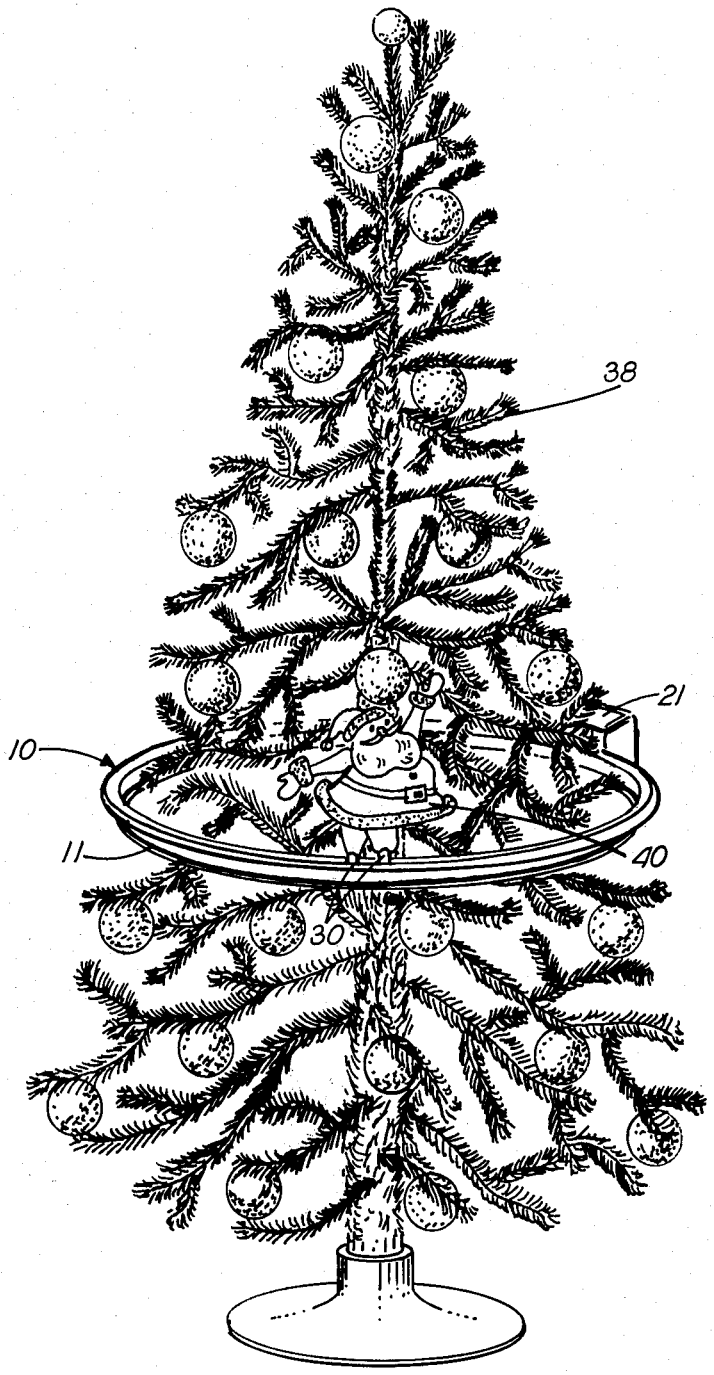
FIG. 5 shows an application of the invention with a novelty item.

FIG. 5 shows the use of the invention in conjunction with a novelty device. More specifically, the tube 10 made of a light plastic material is wound around a Christmas tree 38. A novelty item, such as a Santa Claus figure 40, is attached to the pins 30 of the spring coupler 26. The base 11, which in this case would preferably be made of a light material such as styrofoam, is attached to the tube 10 to assist in retaining the desired shape of the path around the tree as well as for attachment to the tree 38 by hoops or other appropriate means. Also, this base 11 provides a mount for the drive motor 20 and the associated worm 18 and worm gear 16. Typically, for a Christmas tree the base 11 should hold the tube 10 to form a circle having, for example, approximately a two-foot diameter.

In operation, when the motor 20 is activated, the Santa Claus figure 40 will be moved along the path defined by the tube 10 around the tree 38. Of course, additional spring couplers 26 could be threaded into the coil spring 12 to allow for connection of more than one figure along the path of the tube 10. It should be noted in this regard that a spring coupler 26 does not necessarily have to join ends 22 and 24 of the spring 12, but can also be threaded into the middle portion of the spring thus actually acting more as a spring riding means than a spring coupler.

As an example of actual elements to use for a lightweight arrangement such as shown in FIG. 5, a coil spring 12 could be of any convenient material such as steel with 0.025 inches spring wire having 10 coils per linear inch, an outside diameter of 0.250 inches, and an inside diameter of 0.225 inches. Correspondingly, the gear teeth on the pinion gear 16 would be set at 10 teeth per inch. The spring coupler 26 can be made of a lightweight material such as teflon machined to have grooves 28 at a depth approximately 0.010 inch greater than the diameter of the spring wire (in this case the grooves would be 0.035 inches). The outside diameter of the spring coupler 26 is typically set at about 0.010 inches less than the outside diameter of the spring 12 (in this case approximately 0.240 inches). Similarly, the slot 32 of the tube 10 is 0.015 to 0.020 inches wider than the diameter of the pins 30 (which diameter is chosen to match holes in the figure being mounted) to allow for freedom of movement of the enclosed spring 12.

Figure 6:
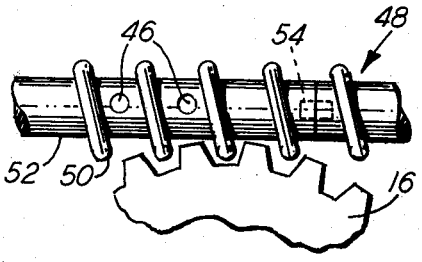
FIGS. 6, 7 and 8 are alternative embodiments of the cable used in conjunction with the present invention.

Although for many applications the light weight of a coil spring is most desirable, there are certain applications where a heavier construction is useful. In such cases, the alternative embodiments shown in FIGS. 6, 7 and 8 may be used. Specifically, FIG. 6 shows a solid helically threaded cable 44 used in place of the coil spring 12. This cable 44 can be made of any convenient metal or plastic material, and may be rigid or flexible depending on the application intended. Pins 46 are provided on the cable 44 to extend through the slot 32 in the tube 10 for connection of an item to be moved.

Figure 7:
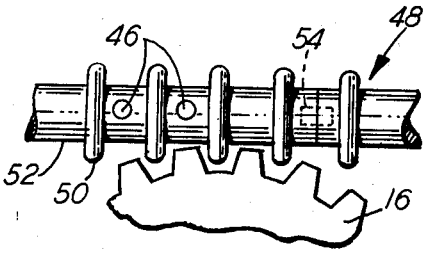
Figure 8:
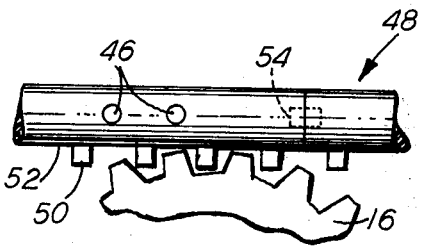

FIGS. 7 and 8 show an alternative to FIG. 6 wherein a cable 48 having alternating large and small diameter regions 50 and 52, respectively, is used instead of a helically threaded cable. In FIG. 7, the large diameter regions extend out from the small diameter regions on both sides, while in FIG. 8, the large diameter region extends from the small diameter region only along the side which will contact the gear 16.

In FIGS. 6, 7 and 8, the ends of the cables 44 and 48 can be joined together by means of a small pin 54. The ends of the cables should be matched as to diameter so that the alternating large and small diameter pattern continues without interruption over the connected ends.

Although the tube 10 is generally made of flexible plastic materials, it is, of course, to be understood that it could be made of other materials, including rigid ones such as steel tubing. It is also understood that the tube could have a cross-sectional shape other than circular (for example, square, rectangular, triangular, elliptical, etc.). Similarly, the slot 32 could be located elsewhere than along the top of the tube 10. Thus, it could be along the bottom or sides at any location convenient for the particular use intended.

Also, although the spring 12 has been described as being made of metal, it is to be understood that it could also be made of a suitable plastic material. The spring 12 is coil wound to have a set number of coils to the inch, which matches the spacing of the teeth of the pinion gear 16.

The speed of the pinion gear 16 is controlled by a chain of gears driven by an electric motor. It is, of course, understood that the gear could be driven by a spring mechanism, a weighted mechanism or by said electric motor. Also, the drive can be arranged to move a figure back and forth along the path rather than in one direction. Similarly, the invention can be used with an open ended track rather than a closed loop, if desired. Further, the pinion gear 16 could be replaced by a rubber wheel having an outer surface which is flexible enough to mesh with the coil spring or cable by being depressed in areas which contact the raised portions of the spring or cable.

This said motion producing mechanism, because of its simplicity and lightweight construction is ideally suited for driving lightweight novelties or displays. It is to be understood, however, that it could be designed to be of a sturdier nature to drive heavier or larger novelties or displays. It could also be used to drive a unit or item added to an existing machine or tool or to drive the item or unit itself. To this end, the above-described mechanism could be used as a conveyor to transport items either along a closed or open path.

Although I have herein shown and described the invention in what I believe to be the most practical and preferred embodiments, it is recognized that departure may be made therefrom within the scope of my invention, which is not to be limited to the details disclosed herein, but is to be accorded the full scope of the claims so as to embrace any and all equivalent structures and devices.

I claim:

1. An apparatus for moving an item along a predetermined path, comprising:

a hollow tube extending along said predetermined path, said tube including an opening which also extends along said predetermined path;

helically threaded means provided inside said hollow tube, said helically threaded means having a predetermined spacing between each of its threads;

drive means for meshing with the spacing between each of the threads of said helically threaded means to move said helically threaded means relative to said hollow tube along said predetermined path; and mounting means coupled to said helically threaded means including means extending through the opening in said hollow tube for mounting said item on said helically threaded means.

2. An apparatus for moving an item along a predetermined closed path, comprising:

a hollow tube extending along said predetermined closed path;

helically threaded means provided inside said hollow tube, said helically threaded means having a predetermined spacing between each of its threads;

drive means for meshing with the spacing between the threads of said helically threaded means to move said helically threaded means relative to said hollow tube along said predetermined closed path; and mounting means coupled to said helically threaded means including means for mounting said item on said helically threaded means.

3. An apparatus according to claim 2, wherein said hollow tube includes an opening which also extends along said closed predetermined path, and said mounting means includes means for extending through said opening for mounting said item to said helically threaded means.

4. An apparatus according to claims 1, 2 or 3, wherein said helically threaded means is a coil spring with a predetermined spacing between its coils.

5. An apparatus according to claim 4, wherein said mounting means includes threads corresponding to said coil spacing, and is threaded into the interior of said coil spring.

6. An apparatus according to claim 1 or 2, wherein the drive means comprises a drive wheel having a flexible surface which meshes with the helically threaded means.

7. An apparatus for moving an item along a predetermined path comprising:

a hollow tube extending along said predetermined path, said holding means including an opening which also extends along said predetermined path;

a cable provided inside said hollow tube, said cable having alternating areas of first and second diameters, wherein said first diameter is larger than said second diameter, and wherein a predetermined spacing exists between adjacent areas of the first diameter;

drive means for meshing with the spacing between adjacent areas of the first diameter to move said cable relative to said hollow tube along said predetermined path; and mounting means coupled to said cable including means extending through the opening in said hollow tube for mounting said item on said cable.

8. An apparatus for moving an item along a predetermined closed path, comprising:

a hollow tube extending along said predetermined closed path;

a cable mounted inside said hollow tube, said cable having alternating areas of first and second diameters, wherein said first diameter is larger than said second diameter, and wherein a predetermined spacing exists between adjacent areas of the first diameter;

drive means for meshing with the spacing between adjacent areas of the first diameter to move said cable relative to said hollow holding means along the predetermined closed path; and means coupled to said cable for mounting said item on said cable.

9. An apparatus according to claim 7 or 8, wherein the drive means comprises a drive wheel having a flexible surface which meshes with the alternating areas of first and second diameters of said cable.

10. An apparatus according to claims 1, 2, 7 or 8, wherein the hollow tube is made of flexible material.

11. An apparatus for moving an item along a predetermined path, comprising:

hollow holding means extending along said predetermined path, said holding means including an opening which also extends along said predetermined path;

helically threaded means provided inside said hollow holding means, said helically threaded means having a predetermined spacing between each of its threads;

drive means for meshing with the spacing between each of the threads of said helically threaded means to move said helically threaded means relative to said hollow holding means along said predetermined path; and mounting means coupled to said helically threaded means including means extending through the opening in said hollow holding means for mounting said item on said helically threaded means, wherein said helically threaded means is a coil spring with a predetermined spacing between its coils, and said mounting means includes threads corresponding to said coil spacings, and is threaded into the interior of said coil spring, and further wherein said means extending through said opening comprises one or more pins which extend from said mounting means through the spacing between the coils of said coil spring.

12. An apparatus for moving an item along a predetermined path, comprising:

hollow holding means extending along said predetermined path, said holding means including an opening which also extends along said predetermined path;

helically threaded means provided inside said hollow holding means, said helically threaded means having a predetermined spacing between each of its threads;

drive means for meshing with the spacing between each of the threads of said helically threaded means to move said helically threaded means relative to said hollow holding means along said predetermined path; and mounting means coupled to said helically threaded means including means extending through the opening in said hollow holding means for mounting said item on said helically threaded means, wherein said helically threaded means is a coil spring with a predetermined spacing between its coils, wherein said mounting means includes threads corresponding to said coil spacing, and is threaded into the interior of said coil spring, and further wherein said drive means comprises a gear having teeth spaced to correspond to the spacing between the coils of said coil spring, and said mounting means includes a flat portion positioned to allow said mounting means to pass by said gear without contact when the portion of the coil spring to which the mounting means is coupled is engaged with said gear.

13. An apparatus for moving an item along a predetermined closed path, comprising:

hollow holding means extending along said predetermined closed path;

helically threaded means provided inside said hollow holding means, said helically threaded means having a predetermined spacing between each of its threads;

drive means for meshing with the spacing between the threads of said helically threaded means to move said helically threaded means relative to said hollow holding means along said predetermined closed path; and mounting means coupled to said helically threaded means including means for mounting said item on said helically threaded means, wherein said helically threaded means is a coil spring having a predetermined spacing between its coils and first and second ends, and said mounting means is a spring coupler having threads corresponding to the spacing between said coils and is threaded into the interior of each of said coil spring ends to form the coil spring into a closed loop.

14. An apparatus according to claim 13, further including additional mounting means mounted along the interior of said coil spring at a location other than between the first and second ends of the coil spring.

15. An apparatus according to claim 13, wherein said hollow holding means includes an opening which also extends along said closed predetermined path, and said mounting means includes means for extending through said opening for mounting said item to said coil spring.

16. An apparatus according to claim 15, wherein said means extending through said opening comprises one or more pins which extend from said mounting means through the spacing between the coils of said coil spring.

17. An apparatus for providing a moving Christmas decoration on a Christmas tree comprising:

a hollow tube forming a closed loop, including an opening which extends completely along said closed loop;

means for holding said hollow tube onto a Christmas tree to encircle said Christmas tree;

helically threaded means provided inside said hollow tube, said helically threaded means having a predetermined spacing between each of its threads;

drive means for meshing with the spacing between the threads of said helically threaded means to move said helically threaded means relative to said hollow tube along said predetermined closed path; and mounting means coupled to said helically threaded means including means for mounting said Christmas decoration on said helically threaded means.

18. An apparatus for providing a moving Christmas decoration on a Christmas tree comprising:

a hollow tube forming a closed loop, including an opening which extends completely along said closed loop;

means for holding a hollow tube onto said Christmas tree to encircle said Christmas tree;

a cable mounted inside said hollow tube, said cable having alternating areas of first and second diameters, wherein said first diameter is larger than said second diameter, and wherein a predetermined spacing exists between adjacent areas of the first diameter;

drive means for meshing with the spacing between adjacent areas of the first diameter to move said cable relative to said hollow holding means along the predetermined closed path; and means coupled to said cable for mounting said Christmas decoration on said cable.

* * * * *